US008974068B1

(12) United States Patent
Thiessen

(10) Patent No.: US 8,974,068 B1
(45) Date of Patent: Mar. 10, 2015

(54) CHEMILUMINESCENT LIGHT STICK WITH ZIP TIE ATTACHMENT

(71) Applicant: Matthew Thiessen, Kapolei, HI (US)

(72) Inventor: Matthew Thiessen, Kapolei, HI (US)

( * ) Notice: Subject to any disclaimer, the term of this patent is extended or adjusted under 35 U.S.C. 154(b) by 74 days.

(21) Appl. No.: 13/864,022

(22) Filed: Apr. 16, 2013

(51) Int. Cl.
*F21K 2/00* (2006.01)
*F21K 2/06* (2006.01)

(52) U.S. Cl.
CPC ..... *F21K 2/06* (2013.01)
USPC ..... 362/34; 362/391

(58) Field of Classification Search
CPC ..... F21K 2/06; C09K 11/07
USPC ..... 362/34, 391, 84, 157, 189; 43/17.5; 248/317
See application file for complete search history.

(56) References Cited

U.S. PATENT DOCUMENTS

| | | | | |
|---|---|---|---|---|
| 3,863,380 | A | 2/1975 | Purlia | |
| 5,213,405 | A | 5/1993 | Giglia | |
| 5,531,418 | A | 7/1996 | Lindgren | |
| 5,673,988 | A * | 10/1997 | Fujita | 362/34 |
| 2012/0275142 | A1* | 11/2012 | Lundy | 362/184 |
| 2014/0041280 | A1* | 2/2014 | Erisman | 43/17 |

* cited by examiner

*Primary Examiner* — Anh Mai
*Assistant Examiner* — Glenn Zimmerman
(74) *Attorney, Agent, or Firm* — Crossley Patent Law

(57) ABSTRACT

A chemiluminescent light stick with zip tie attachment that includes an illuminable member having a first end and a second end, a connect aperture disposed upon the first end, and a zip tie disposed upon the connect aperture, wherein said chemiluminescent light stick with zip tie attachment is threadably securable to depend from an extant object and radiate light therefrom.

4 Claims, 3 Drawing Sheets

CHEMILUMINESCENT LIGHT STICK WITH ZIP TIE ATTACHMENT

BACKGROUND OF THE INVENTION

Various types of light and glow sticks are known in the prior art. However, what is needed is a chemiluminescent light stick with zip tie attachment that includes an illuminable member having a first end and a second end, a connect aperture disposed upon the first end, and a zip tie disposed upon the connect aperture, wherein said chemiluminescent light stick with zip tie attachment is threadably securable to depend from an extant object and radiate light therefrom.

FIELD OF THE INVENTION

The present invention relates to a chemiluminescent light stick with zip tie attachment, and more particularly, to a chemiluminescent light stick with zip tie attachment that includes an illuminable member having a first end and a second end, a connect aperture disposed upon the first end, and a zip tie disposed upon the connect aperture, wherein said chemiluminescent light stick with zip tie attachment is threadably securable to depend from an extant object and radiate light therefrom.

SUMMARY OF THE INVENTION

The general purpose of the chemiluminescent light stick with zip tie attachment, described subsequently in greater detail, is to provide a chemiluminescent light stick with zip tie attachment which has many novel features that result in a chemiluminescent light stick with zip tie attachment which is not anticipated, rendered obvious, suggested, or even implied by prior art, either alone or in combination thereof.

The present chemiluminescent light stick with zip tie attachment has been devised to provide a ready and expedient attachment means whereby an illuminable member may be secured depending form an extant object to render light therefrom. The present invention is contemplated for use in decorating an area during festive occasions and parties, for example, or for use when camping, for example, when positioning light aloft is useful, or to render a particular object more visible when desired. The present chemiluminescent light stick with zip tie attachment is also contemplated for military use, providing an expedient means to render light aloft, and rapidly remove light therefrom, when needed.

The present chemiluminescent light stick with zip tie attachment includes an illuminable member having a first end and a second end. A connect aperture is disposed upon the first end and a zip tie is disposed atop the connect aperture, said zip tie threadably securable within the connect aperture in the manner of to zip ties familiar in the art. When the zip tie is threaded into the connect aperture, it is contemplated that the illuminable member will be activated and the chemiluminescent light stick with zip tie attachment will illuminate.

A plurality of color chemiluminescent light sticks with zip tie attachments are contemplated as part of this invention, whereby multiple chemiluminescent light sticks may be depended from extant objects proximal to a desired area to provide more light, for example, or to arrange a colorful array of illuminable members whereby a festive atmosphere is created.

To interconnect chemiluminescent light sticks with zip tie attachments together, an interconnect aperture is disposed upon the second end. A zip tie of a second proximally positioned chemiluminescent light stick with zip tie attachment may therefore be threadably inserted through the interconnect aperture of a first chemiluminescent light stick with zip tie attachment, and then threadably secured in said second chemiluminescent light stick with zip tie attachment's respective connect aperture (whereby said second chemiluminescent light stick with zip tie attachment is illuminated) and thus secured in tandem. Additional chemiluminescent light sticks with zip tie attachments are thence attachable thereto, as desired, to effect an array of visually stimulating illuminable members, as desired, or to render more light from a particular area, when needed.

For expedient removal of each chemiluminescent light stick with zip tie attachment, a break point is disposed upon the zip tie, where the zip tie joins to the connect aperture. The break point includes a weakened portion of the zip tie, having a shorter width and depth, whereby a person may readily snap the zip tie to remove said chemiluminescent light stick with zip tie when abrupt forcing is applied thereto.

Thus has been broadly outlined the more important features of the present chemiluminescent light stick with zip tie attachment so that the detailed description thereof that follows may be better understood and in order that the present contribution to the art may be better appreciated.

Objects of the present chemiluminescent light stick with zip tie attachment, along with various novel features that characterize the invention are particularly pointed out in the claims forming a part of this disclosure. For better understanding of the chemiluminescent light stick with zip tie attachment, its operating advantages and specific objects attained by its uses, refer to the accompanying drawings and description.

BRIEF DESCRIPTION OF THE DRAWINGS

Figures

DETAILED DESCRIPTION OF THE DRAWINGS

Figure 1:
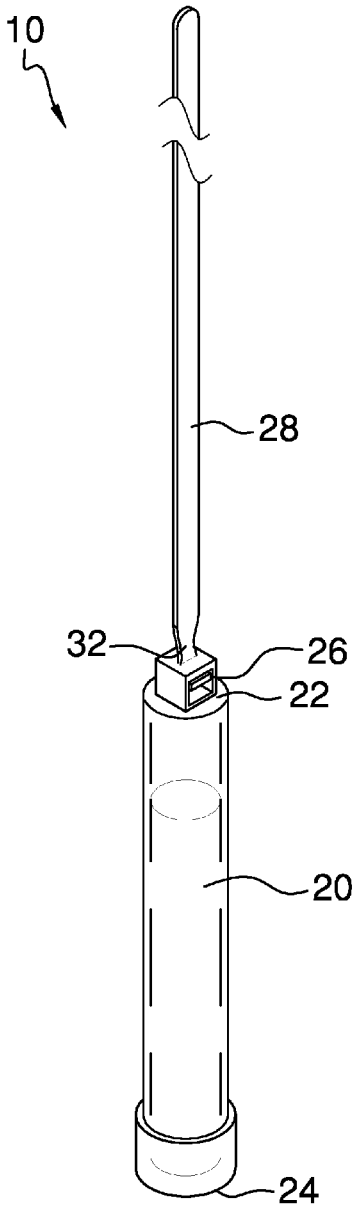
FIG. 1 is an isometric view.
Figure 2:
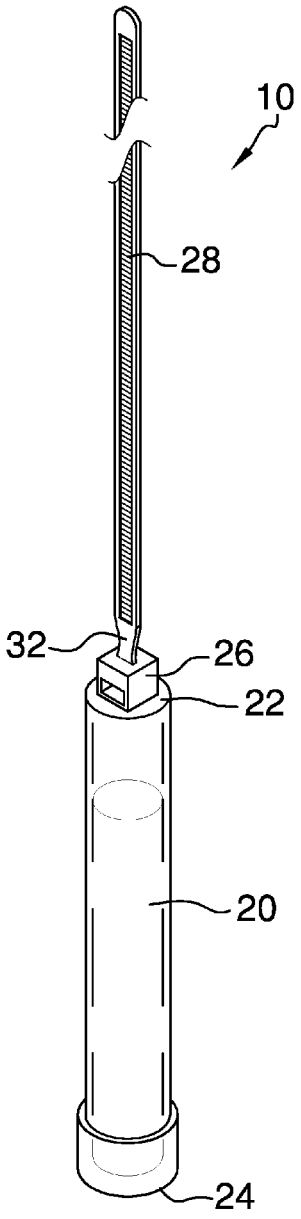
FIG. 2 is am isometric view.
Figure 3:
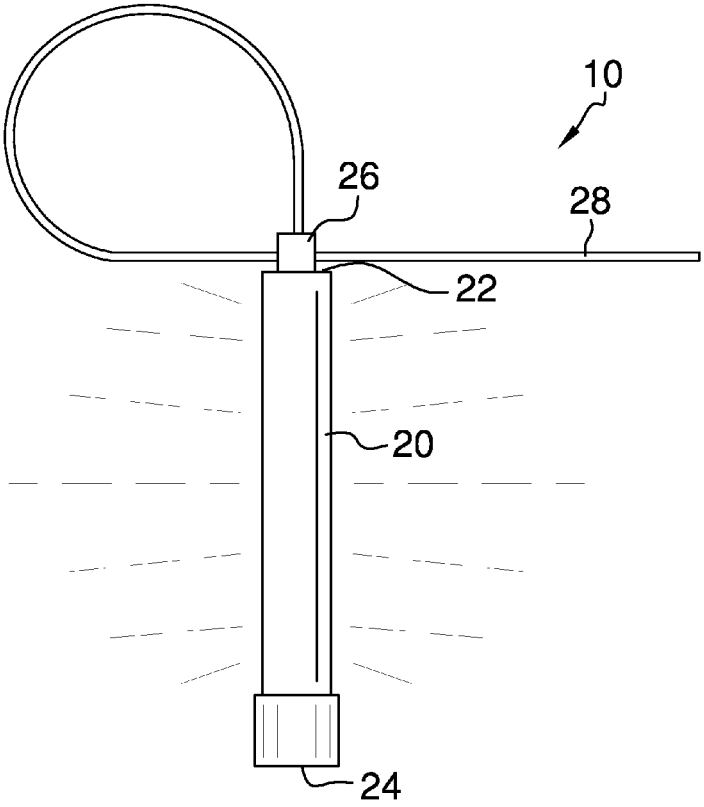
FIG. 3 is a side view.
Figure 4:
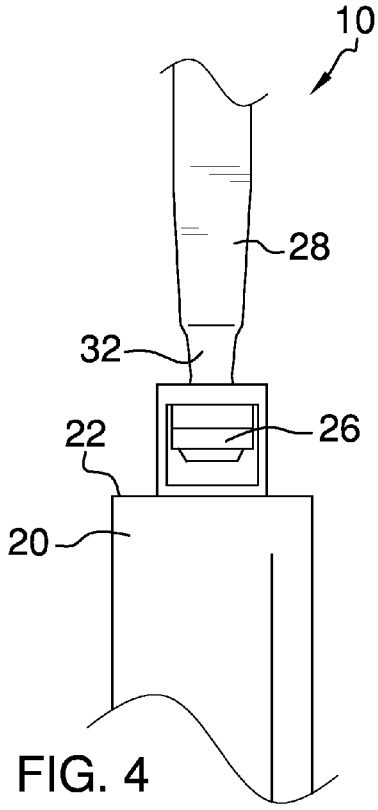
FIG. 4 is a detail view of a first end.

With reference now to the drawings, and in particular FIGS. 1 through 6 thereof, example of the instant chemiluminescent light stick with zip tie attachment employing the principles and concepts of the present chemiluminescent light stick with zip tie attachment and generally designated by the reference number 10 will be described.

Referring to FIGS. 1 through 6 a preferred embodiment of the present chemiluminescent light stick with zip tie attachment 10 is illustrated.

The present chemiluminescent light stick with zip tie fastener 10 has been devised to enable an expedient and easy means to depend an illuminable member 20 upon an extant object, whereby said illuminable member 20 may be releasably secured aloft and radiate light, as desired, therefrom.

The present chemiluminescent light stick with zip tie attachment 10, therefore, includes an illuminable member 20 having a first end 22 and a second end 24. A connect aperture 26 is disposed upon the first end 22 and a zip tie 28 is disposed endwise upon the connect aperture 26, said zip tie 28 activating the illuminable member 20 when threadably inserted into the connect aperture 26.

Figure 5:
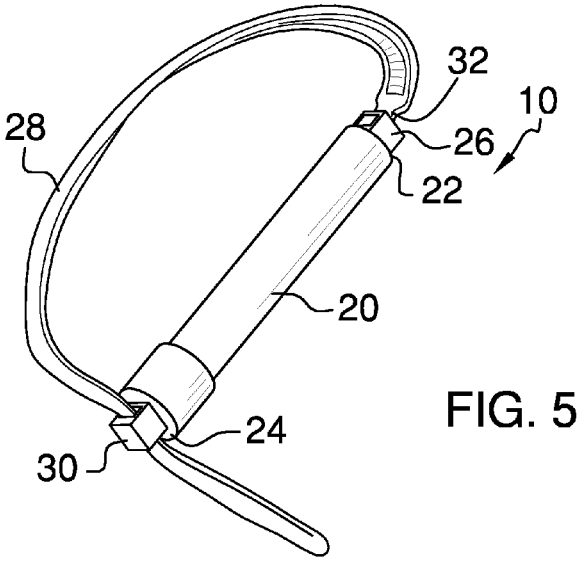
FIG. 5 is an isometric view with a zip tie threaded through an interconnect aperture.
Figure 6:
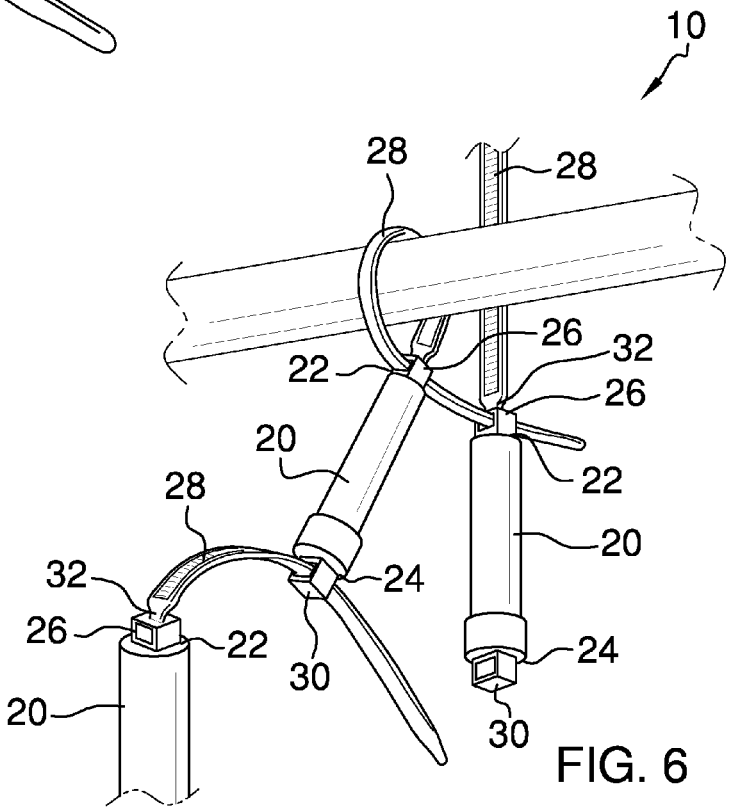
FIG. 6 is an in-use view showing a plurality of chemiluminescent light stick with zip ties interconnected and suspended from an object.

As shown in FIG. 5, an interconnect aperture 30 is disposed endwise on the second end 24 of the illuminable member 20 and additional chemiluminescent light sticks with zip tie attachments 10 may be attached thereto by threading the zip tie 28 therethrough and then inserting said zip tie 28 into the respective connect aperture 26 whereby said chemiluminescent light stick with zip tie attachment 10 is activated and the illuminable member 20 illuminated.

A plurality of colors are contemplated as part of the present invention 10, whereby a plurality of different colored chemiluminescent light sticks with zip tie attachments 10 are interconnectable, or expediently positioned depending from an object, as desired, to decorate a particular space or to provide light, say, while camping, or to render a particular object more visible, as desired.

For expedient removal of each chemiluminescent light stick with zip tie attachment 10 once activated and attached to an extant object, a break point 32 is disposed upon the zip tie 28 where said zip tie 28 attaches to the connect aperture 26. The break point 32 is a weakened portion of the zip tie 28, and abrupt forcing against said break point 32 snaps the zip tie 28 at the break point 32. The zip tie 28 is thus released at the break point 32, when broken, and the chemiluminescent light stick is rapidly removable and may be discarded, as desired.

What is claimed is:

1. A chemiluminescent light stick with zip tie attachment comprising:

an illuminable member;

a zip tie disposed endwise upon said illuminable member;

a connect aperture disposed between the illuminable member and the zip tie, wherein the zip tie inserts and secures within the connect aperture and activates the chemiluminescent light stick when the zip tie is threaded therethrough, whereby the illuminable member illuminates when the zip tie is threaded through the connect aperture;

a breakpoint disposed upon the zip tie where said zip tie attaches to the connect aperture;

wherein the chemiluminescent light stick with zip tie is attachable around an extant object, as desired.

2. The chemiluminescent light stick with zip tie attachment of claim 1 wherein an interconnect aperture is disposed endwise upon the opposite end of the illuminable member to which the zip tie is disposed, whereby said illuminable member is interconnectable with additional chemiluminescent light sticks with zip tie attachments, as desired.

3. The chemiluminescent light stick with zip tie attachment of claim 2 wherein abrupt forcing of the zip tie at the break point severs the zip tie from the connect aperture whereby the chemiluminescent light stick with zip tie attachment may be expediently removed from installation.

4. A chemiluminescent light stick with zip tie attachment comprising:

an illuminable member having a first end and a second end;

a connect aperture disposed upon the first end;

a zip tie disposed endwise upon the connect aperture, said zip tie activating the illuminable member when threadably inserted into the connect aperture;

a break point disposed upon the zip tie where said zip tie attaches to the connect aperture, said break point severing said zip tie from said connect aperture when abruptly forced; and an interconnect aperture disposed endwise on the second end;

wherein the chemiluminescent light stick with zip tie is illuminable when attached around an extant object, as desired, by means of the zip tie.

* * * * *